US005816994A

United States Patent [19]

Hill et al.

[11] Patent Number: 5,816,994

[45] Date of Patent: Oct. 6, 1998

[54] BOX-BLANK PRINTER/SLOTTING APPARATUS

[75] Inventors: Alan M. Hill, Topeka; William R. Meeks, Lawrence, both of Kans.

[73] Assignee: Lawrence Paper Company, Lawrence, Kans.

[21] Appl. No.: 880,556

[22] Filed: Jun. 23, 1997

Related U.S. Application Data

[63] Continuation of Ser. No. 546,789, Oct. 23, 1995, abandoned.

[51] Int. Cl.[6] ..... B31B 1/88

[52] U.S. Cl. ..... 493/324; 493/55; 493/60; 493/64; 493/321; 493/8; 493/370; 493/10; 101/184

[58] Field of Search ..... 493/8, 22, 24, 493/25, 34, 53–55, 59, 64, 187, 188, 227, 228, 240, 241, 270, 320, 321, 323, 324, 355, 363, 365, 367, 369, 370, 10; 83/332, 304, 322, 564, 678; 101/115, 182–185, 226, 227, 247; 198/346.2, 631.1

[56] References Cited

U.S. PATENT DOCUMENTS

| | | | |
|---|---|---|---|
| 33,061 | 8/1861 | Bronson | 198/631.1 |
| 1,850,801 | 3/1932 | Langston et al. . | |
| 2,181,211 | 11/1939 | Sieg . | |
| 2,191,988 | 2/1940 | Greenwood . | |
| 3,131,631 | 5/1964 | Haskin, Jr. | 101/247 |
| 3,368,461 | 2/1968 | Grobman . | |
| 3,473,468 | 10/1969 | Vandeman et al. | 101/184 |
| 3,477,367 | 11/1969 | Richards | 101/184 |
| 3,611,884 | 10/1971 | Hottendorf | 493/55 |
| 3,648,605 | 3/1972 | Hottendorf . | |
| 3,665,853 | 5/1972 | Hartmeister et al. | 101/247 |
| 3,769,910 | 11/1973 | Heimlicher et al. | 101/177 |
| 3,800,698 | 4/1974 | Kist et al. | 101/184 |
| 3,921,519 | 11/1975 | Zimmer | 101/116 |
| 4,108,067 | 8/1978 | Werner | 101/247 |
| 4,218,972 | 8/1980 | Fujishiro | 101/184 |
| 4,239,001 | 12/1980 | Kataoka | 101/182 |
| 4,256,037 | 3/1981 | Vertegaal | 101/182 |
| 4,290,361 | 9/1981 | Fowler et al. | 101/182 |
| 4,458,591 | 7/1984 | Guaraldi | 101/247 |
| 4,471,693 | 9/1984 | Tsukasaki | 101/183 |
| 4,604,083 | 8/1986 | Barny et al. | 493/34 |

(List continued on next page.)

*Primary Examiner*—Michael J. Carone
*Assistant Examiner*—Darren Ark
*Attorney, Agent, or Firm*—Hovey, Williams, Timmons & Collins

[57] ABSTRACT

A box blank forming apparatus includes at least one printing assembly, a slotting assembly, and a feeding and conveying mechanism for feeding blanks through the apparatus. The printing assembly includes a rotatable printing cylinder, and the slotting assembly includes a rotatable blade. The feeding and conveying mechanism brings the blanks into contact with the printing cylinder and the slotter blade to complete printing and slotting operations on the blanks in the formation of boxes. An interrupter is provided in association with the printing assembly for removing the blanks from contact with the printing cylinder, and similar structure can also be provided with the slotting assembly for removing the blanks from contact with the slotter blade. A controller is provided for controlling operation of the interrupter of the printing assembly. The controller actuates the interrupter to bring each blank into contact with the printing cylinder only while a single impression is made on the blank, and to remove each blank from contact with the printing cylinder before and after the single impression is made. Thus, it is possible to use a single printing cylinder of fixed circumference to print on blanks of variable length, even when the blanks are longer than the printing cylinder circumference. The controller may be used to also actuate the interrupter structure of the slotter wheel assembly to bring each blanks into contact with the slotting blade only while a single slotting operation is carried out by the slotting blade, and to remove each blank from contact with the slotting blade before and after the single slotting operation is made. This allows the slotter wheel assembly to also accommodate box blanks of various sizes.

9 Claims, 4 Drawing Sheets

U.S. PATENT DOCUMENTS

| | | | |
|---|---|---|---|
| 4,645,066 | 2/1987 | Richardson | 198/631.1 |
| 4,759,741 | 7/1988 | Chisholm | 493/55 |
| 4,805,502 | 2/1989 | Ishigure | 83/332 |
| 5,081,927 | 1/1992 | Jahn | 101/184 |
| 5,123,887 | 6/1992 | Shimura | 493/34 |
| 5,163,891 | 11/1992 | Goldsborough et al. | 493/55 |
| 5,228,390 | 7/1993 | Jahn | 101/247 |
| 5,297,462 | 3/1994 | Creaden | 83/332 |
| 5,316,538 | 5/1994 | Hill et al. . | |
| 5,327,804 | 7/1994 | Creaden | 83/332 |
| 5,338,019 | 8/1994 | Hill et al. . | |
| 5,351,589 | 10/1994 | Creaden | 83/332 |
| 5,445,076 | 8/1995 | Sugiyama et al. | 101/247 |
| 5,540,128 | 7/1996 | Creaden | 83/332 |
| 5,641,055 | 6/1997 | Anderson | 198/631.1 |

BOX-BLANK PRINTER/SLOTTING APPARATUS

This application is a continuation of application Ser. No. 08/546,789, filed Oct. 23, 1995, now abandoned.

BACKGROUND OF THE INVENTION

1. Field of the Invention

The present invention relates generally to the art of box blank formation, and more particularly to a box blank forming apparatus having a printing assembly, a slotting assembly, and a controller for selectively interrupting printing and slotting of each blank to regulate the positioning and number of imprints and slots formed in each blank, regardless of the length of the blanks.

2. Discussion of the Prior Art

Conventional box making operations involve initially die cutting a box blank from a sheet of corrugated paper board or other suitable material, followed by creasing and slotting the blank to define the sides and end flaps of the blank. It is also possible to print on the blank by passing it through one or more printing assemblies prior to creasing and slotting.

In conventional box blank forming machines, the blanks are fed from a supply stack by a conventional sheet feeder or the like, and are advanced through the printing assemblies and into the creasing and slotting assemblies by a conveyor so that each blank is imprinted and includes a series of spaced slot pairs of desired length separated by continuous creases. Each printing assembly includes a printing cylinder supported for rotation on the frame of the apparatus, an inking assembly for inking the printing cylinder, and an impression cylinder opposing the printing cylinder for bringing blanks into contact with the printing cylinder for printing. The conveyor is perforated, and several vacuum trays underlie the conveyor for permitting a vacuum to be drawn through the conveyor so that blanks are held against the conveyor as they are conveyed between the printing and impression cylinders of each printing assembly and through the apparatus.

In order to permit each printing assembly to be independently removed from operation, the impression cylinder of each printing assembly is supported by eccentric hubs that allow shifting of the impression cylinder toward and away from the printing cylinder in a direction generally transverse to the travel path of the blanks through the apparatus. The vacuum trays of the conveyor are also supported by the eccentric hubs so that the conveyor can also be moved toward and away from the printing cylinder. By providing this construction, it is possible to set up the machine for single color printing by removing all but one of the printing assemblies from operation, or to set up any number of printing assemblies for multi-color printing, it being understood that each assembly is used to print a single color on the blanks.

A mechanism is provided for manually turning the eccentric hubs during down time of the apparatus to shift the impression cylinder and conveyor between a printing position adjacent the printing cylinder in which the impression cylinder and conveyor bring blanks into contact with the printing cylinder, and an interrupted position in which the impression cylinder and conveyor are spaced from the printing cylinder by a distance sufficient to allow blanks to be conveyed past the printing cylinder without being printed.

The creasing assembly of a conventional machine includes an upper drive shaft on which a plurality of creasing wheels are supported for rotation. An anvil roller opposes the creasing wheels and defines a nip into which the blanks are conveyed so that a series of longitudinal creases are formed in the blanks as they pass through the assembly. The slotting assembly of a conventional box blank forming machine includes a plurality of slotting wheel mechanisms supported on a drive shaft. A lower anvil roller opposes the slotting wheel mechanism and defines a nip into which the blanks are conveyed as they leave the creasing assembly so that at least one set of laterally spaced slots are formed in each blank as it is conveyed through the slotting assembly.

A problem encountered with conventional printing assemblies and with conventional slotting assemblies is that there are limitations on the size of blanks that may be handled. In particular, since the printing cylinders and slotting wheel mechanisms of conventional machines are of fixed circumference, the maximum box blank length which may be formed using such structure is limited to lengths less than this fixed circumference. It is not possible to produce box blanks of a length greater than the circumference of the printing cylinders and slotting wheel mechanisms of a particular apparatus without fitting the apparatus with larger cylinders and slotting mechanisms. Such modifications to any apparatus are expensive, and result in a significant amount of down time.

U.S. Pat. Nos. 5,297,462 and 5,327,804 disclose slotting wheel mechanisms having dynamically retractable slotter blades that allow the formation of boxes of various sizes, including lengths larger than the circumference of the slotting wheel mechanisms. The disclosure of these patents is hereby incorporated into the present application by this express reference. The slotting wheel mechanisms disclosed in the noted patents provide greatly improved box making operations which allow the "skipping" of cutting during one or more successive slotting wheel revolutions. With this configuration, blanks of virtually any size may be readily slotted without stopping the slotting wheel mechanism and without the need for employing larger diameter mechanisms. However, due to the inability of conventional printing assemblies to accommodate similarly oversized blanks, any printer/slotter apparatus incorporating such an improved slotting wheel mechanism would be limited to use with blanks smaller than the circumference of the printing cylinder. Thus, the advantage gained by the improvement in the slotting wheel mechanism would go unrealized in the printer/slotter apparatus due to the restrictions imposed by the printing assembly.

OBJECTS AND SUMMARY OF THE INVENTION

It is an object of the present invention to provide a printing assembly having a means for interrupting printing on the fly during the passage of each blank through the assembly to enable a single impression to be made on each blank as the blanks are conveyed through the assembly, even when the blanks are of a length greater than the circumference of the printing cylinder used in the assembly.

It is another object of the present invention to combine control of both the printing assembly and slotter wheel assembly of a box blank forming apparatus to enable handling of box blanks of various sizes, including sizes greater than the circumferences of the printing cylinders and slotter wheels of the apparatus.

In accordance with these and other objects evident from the following description of a preferred embodiment of the invention, a box blank forming apparatus is provided for forming blanks of variable length. The apparatus includes a printing cylinder having a central longitudinal axis and being supported on the frame of the apparatus for rotation about the longitudinal axis, and a drive means for driving rotation of the printing cylinder. An impression cylinder is supported on the frame for rotation about an axis parallel to the longitudinal axis of the printing cylinder, and a feeding means is provided for feeding the sheets along a travel path extending between the printing cylinder and the impression cylinder.

The apparatus also includes an interrupting means for moving the and impression cylinder toward and away from the printing cylinder between a printing position in which the impression cylinder and feeding means bring sheets into contact with the printing cylinder and an interrupted position in which the impression cylinder and feeding means are spaced from the printing cylinder by a distance sufficient to allow sheets to remain out of contact with the printing cylinder. A control means is provided for actuating the interrupting means to move the printing and impression cylinders relative to one another between the printing and interrupted positions during both rotation of the printing cylinder and operation of the feeding means to enable a single impression to be made on each sheet as the sheets are passed between the cylinders, regardless of the length of the sheets.

By providing a box forming apparatus in accordance with the present invention, numerous advantages are realized. For example, by controlling the interrupting means to interrupt printing on the fly during the passage of each blank past the printing cylinder, it is possible to print a single time on each blank as the blanks are conveyed through the assembly, even when the blanks are of a length greater than the circumference of the printing cylinder used in the assembly.

In addition, by providing a printing assembly having this capability of handling universally sized blanks, it is possible to combine control of the printing assembly and of a suitable slotting wheel mechanism to permit printing and slotting of such universally sized blanks in a single apparatus. Thus, recent advances made in the design of slotting wheel mechanisms can be used with the present invention to increase the versatility of a box blank forming apparatus, and both the printing and slotting operations can be controlled to accommodate blanks of various sizes.

BRIEF DESCRIPTION OF THE DRAWING FIGURES

The preferred embodiment of the present invention is described in detail below with reference to the attached drawing figures, wherein.

DETAILED DESCRIPTION OF THE PREFERRED EMBODIMENT

Figure 1:
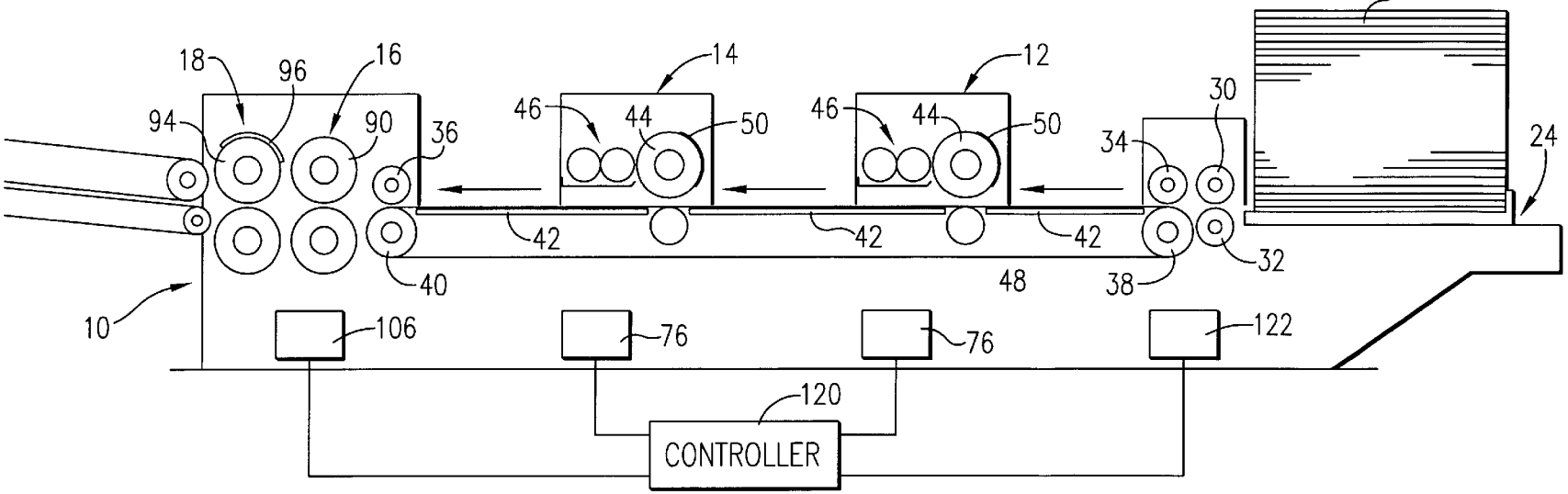
FIG. 1 is a schematic side elevational view of a box blank forming apparatus constructed in accordance with the preferred embodiment.

A box blank forming apparatus constructed in accordance with the preferred embodiment is illustrated in FIG. 1, and broadly includes a frame 10, a pair of printing assemblies 12, 14, a scoring assembly 16, and a slotting assembly 18. The frame includes a pair of laterally spaced side walls 20, 22, shown in FIG. 5, that are secured together by suitable means and are supported on the floor of a production facility. The spacing between the side walls establishes the maximum width of box blanks capable of being formed by the apparatus.

Returning to FIG. 1, a conventional blank feeder assembly 24 is supported at one end of the frame and defines the upstream end of the apparatus. An example of a sheet feeder capable of use in the apparatus is illustrated in U.S. Pat. No. 5,338,019, the disclosure of which is incorporated herein by this express reference. A stack of box blanks 26 are loaded in the feeder and fed serially by the feeder to the apparatus. A conveyor 28 extends between the sheet feeder assembly and the scoring assembly 16 for conveying blanks through the two printing assemblies 12, 14 and directing the blanks into the scoring and slotting assemblies. A pair of feed rollers 30, 32 are positioned between the sheet feeder assembly and the conveyor for guiding movement of blanks to the conveyor, and an additional upper feed roller 34 is provided at the upstream end of the conveyor for holding the blanks against the conveyor as the blanks are fed from the stack. Another upper feed roller 36 is provided at the downstream end of the conveyor for guiding blanks into the scoring assembly 16.

The conveyor 28 is supported by a pair of end rollers 38, 40 that are driven to move the conveyor during operation of the apparatus so that box blanks are conveyed on an upper run of the conveyor at a predetermined rate through the printing assemblies and into the scoring and slotting assemblies. The conveyor is formed of a perforated material, and a plurality of vacuum trays 42 extend beneath and support the upper run of the conveyor. The vacuum trays each include a perforated upper support surface and are connected to a suitable source of negative pressure so that during operation, the blanks are drawn to and held against the upper run of the conveyor as they travel through the apparatus.

The printing assemblies 12, 14 are each adapted to print a single color on the blanks during operation but otherwise are identical to one another. Thus, the number of printing assemblies provided on the apparatus determines the maximum number of colors in which printing can be carried out. Each printing assembly includes a printing cylinder 44, an inking assembly 46 for inking the printing cylinder, and an impression cylinder 48 for establishing contact between the box blanks and the printing cylinder as the blanks are conveyed between the cylinders so that an impression is made on the blanks. The printing cylinder 44 is rotatable about a central longitudinal axis that extends in a direction transverse to the travel path defined by the conveyor, and includes a fixed circumference on which a printing plate 50 is supported.

Figure 5:
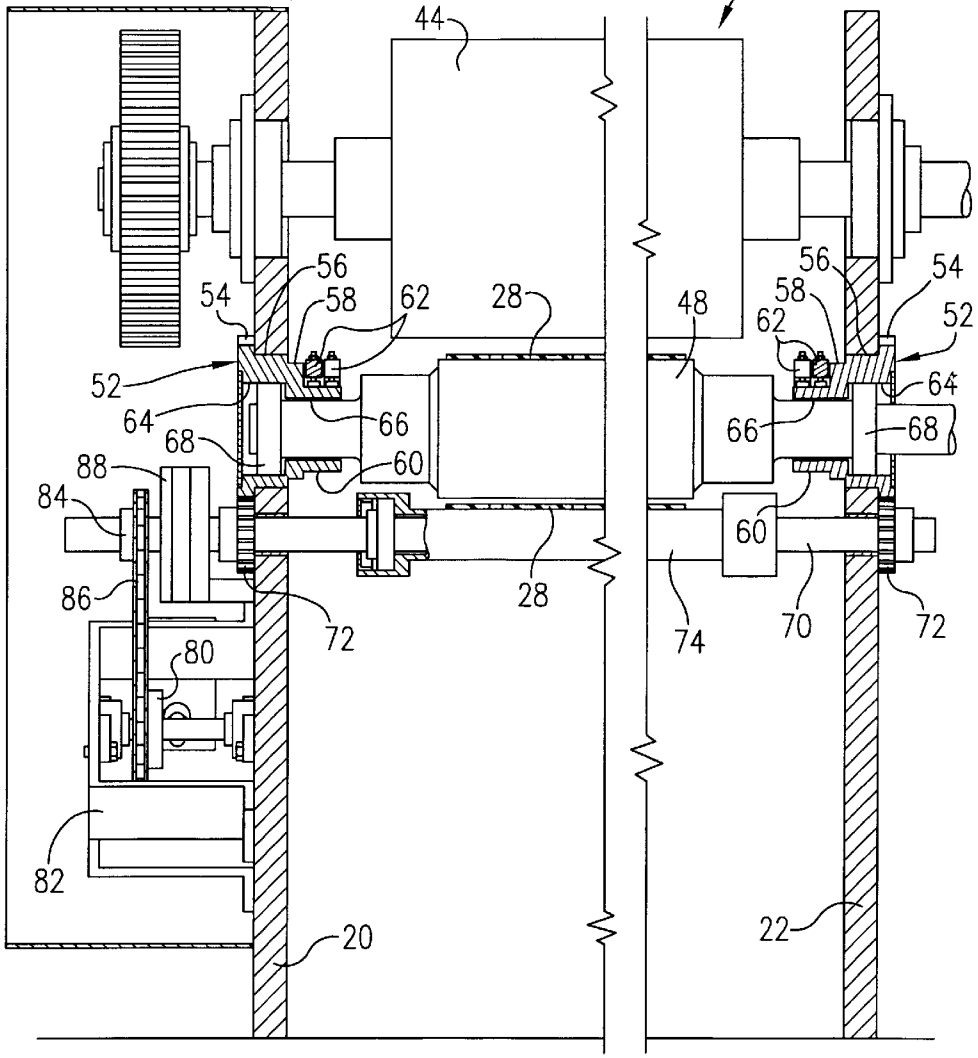
FIG. 5 is a sectional view taken along line 5—5 of FIG. 4.

The impression cylinder 48 of each printing assembly 12, 14 is supported between the upper and lower runs of the conveyor 28 for rotation about an axis extending in a direction parallel to the longitudinal axis of the associated printing cylinder. As illustrated in FIG. 5, an interrupting means is provided for moving the impression cylinder 48 toward and away from the printing cylinder in a direction transverse to the travel path between a printing position in which the impression cylinder and conveyor bring sheets passing between the cylinders 44, 48 into contact with the printing cylinder and an interrupted position in which the impression cylinder and conveyor are spaced from the printing cylinder by a distance sufficient to allow sheets passing between the cylinders to remain out of contact with the printing cylinder.

Preferably, the interrupting means includes a pair of eccentric hubs 52 within which the ends of the impression cylinder are supported, and a means for rotating the hubs to shift the impression cylinder toward and away from the printing cylinder in a direction transverse to the travel path defined by the conveyor. Each hub 52 is elongated, presenting opposed inner and outer axial ends. In addition, a number of longitudinally-spaced stepped regions 54, 56, 58, 60 are formed on the outer surface of the hub between the axial ends. The stepped region 54 adjacent the outer axial end of the hub includes a toothed circumference defining a gear by which the hub is rotated. The stepped region 56 adjacent the gear presents a cylindrical outer support surface having a diameter smaller than the root diameter of the gear. The support surface 56 is received in a bore formed in one of the side walls 20, 22 of the frame so that the hub is rotatable, and the gear 54 and the support surface 56 are concentric so that rotation of the gear is guided by the support surface.

The stepped region 60 adjacent the inner axial end of the hub is of a diameter smaller than the other stepped regions, and includes a cylindrical outer circumferential surface defining a central longitudinal axis that is off-set from the longitudinal axis defined by the gear 54 and support surface 56. The vacuum trays 42 adjacent the impression cylinder 48 each include laterally spaced, longitudinally extending arms 62, and each arm extends over and is supported on top of the inner stepped region of one of the hubs so that when the hubs are rotated, the ends of the vacuum trays adjacent the printing assembly are shifted upward and downward relative to the printing cylinder, raising and lowering the conveyor at the same time. The region 58 adjacent to the inner stepped region 60 defines a shoulder for maintaining the spacing between the vacuum trays 42 and the side walls of the frame.

A longitudinally extending bore is provided in each hub, and presents two stepped regions 64, 66. Both regions are cylindrical in shape and concentric with one another, presenting a longitudinal axis that is off-set from the longitudinal axis defined by the gear 54 and support surface 56. The outer stepped region 64 of the bore is a large diameter region within which a bearing assembly 68 is received. The inner stepped region 66 of the bore is a small diameter region within which an axial end of the impression cylinder is received. The ends of the cylinder are supported within the bearing assemblies 68 to enable rotation of the impression cylinder about the axis of the bore. In addition, this construction enables the impression cylinder to be shifted toward and away from the printing cylinder when the hubs are rotated.

A transfer shaft 70 is supported on the frame beneath the impression cylinder for rotation about an axis extending in a direction parallel to the axis of the impression cylinder. The ends of the transfer shaft protrude beyond the side walls of the frame and a pair of gears 72 are fixed to the shaft at positions in alignment with the hub gears 54. Thus, rotation of the transfer shaft is transmitted to both hubs so that the impression cylinder is moved toward and away from the printing cylinder without upsetting the parallel relationship between the impression and printing cylinders. A belt support roller 74 is mounted for rotation on the transfer shaft at a position between the side walls of the frame, and the lower run of the conveyor 28 is supported by the roller. Preferably, bearing assemblies are provided on the transfer shaft for permitting this relative rotation of the support roller.

Figure 2:
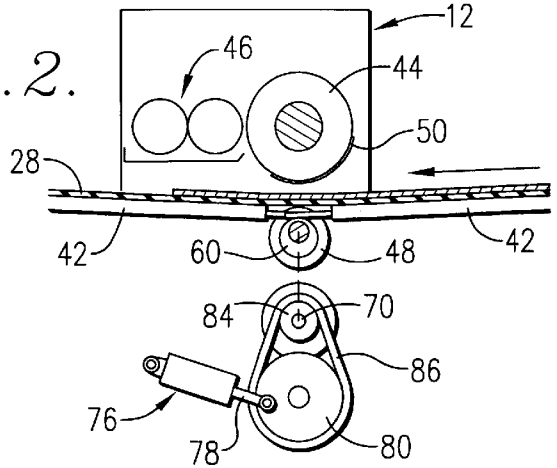
FIG. 2 is a schematic side sectional view of a printing assembly forming a part of the box blank forming apparatus, illustrating the assembly in an interrupted position in which no printing is carried out.
Figure 3:
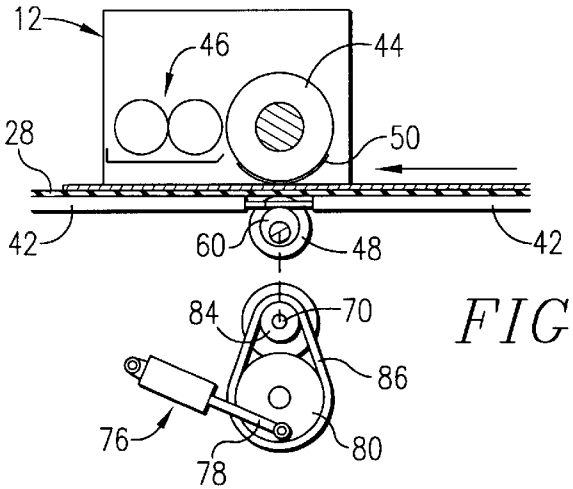
FIG. 3 is a schematic side sectional view of the printing assembly, illustrating the assembly in a printing position.
Figure 4:
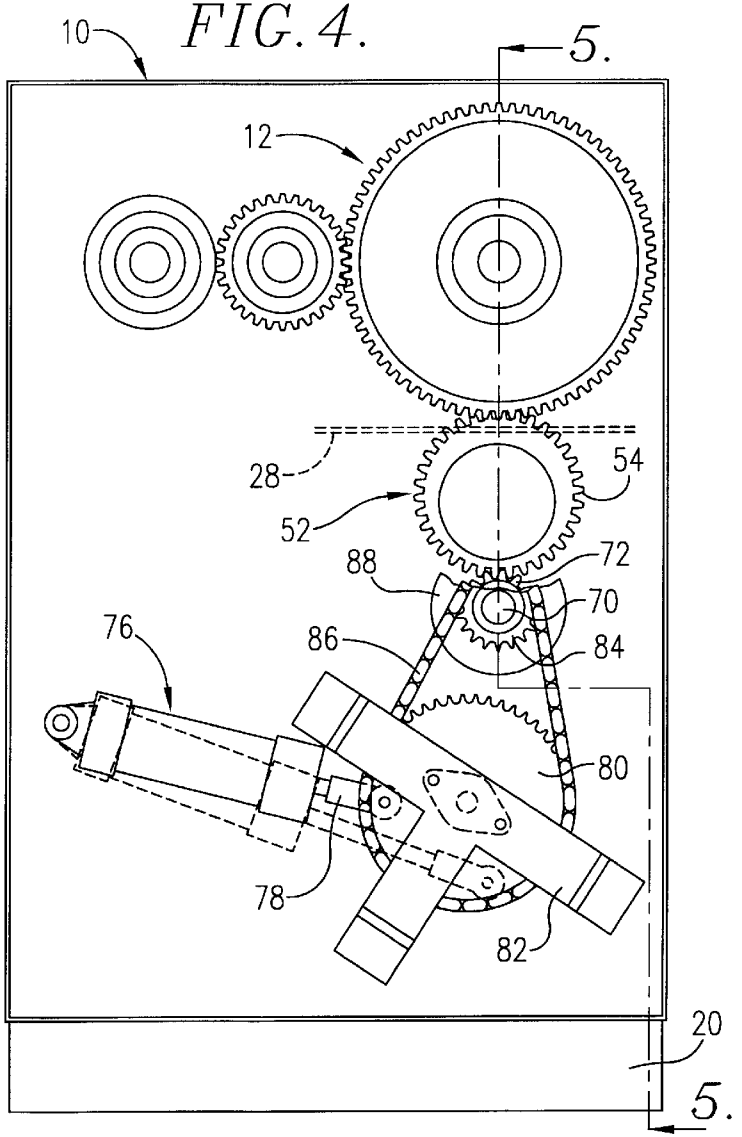
FIG. 4 is a side elevational view of the printing assembly in the interrupted position.

A pneumatic piston-and-cylinder actuator 76 is supported on the side wall of the frame by a pin and may be pivoted about the pin to accommodate extension and retraction of a piston forming a part of the actuator. A rotatable sprocket 80 is supported on the frame by a shaft that extends between the side wall of the frame and a bracket 82 that is secured to the frame. The piston includes a distal end that is connected to the sprocket by a pin that permits relative pivotal movement between the piston and the sprocket. A second sprocket 84 is fixed to the transfer shaft 70 immediately above the lower sprocket, and a chain 86 is received on the sprockets 80, 84 for transmitting rotation of the lower sprocket to the upper sprocket. When the piston is extended from the position shown in solid lines in FIG. 4 to the position shown in dashed lines, the sprocket 80 is rotated in a counterclockwise direction. This rotation is transmitted to the transfer shaft 70 and through the gears 72 to the hubs 52, rotating the hubs in a clockwise direction from the interrupted position shown in FIGS. 2, 4 and 5 to the printing position shown in FIG. 3. Because the impression cylinder 48 is supported on an axis eccentric from the axis about which the hubs rotate, the impression cylinder is shifted upward toward the printing cylinder 44. Likewise the ends of the vacuum trays 42 supported by the hubs are lifted into proximity with the printing cylinder raising the conveyor 28 to the printing position.

As shown in FIG. 5, an electric brake 88 is received on the transfer shaft at a position adjacent to the upper sprocket 84, and is supported on the side wall 20 of the frame. The brake is of conventional construction, and is actuated once the impression cylinder and conveyor have been lifted to the printing position in order to hold them in place. Likewise, the brake is disengaged prior to lowering the impression cylinder to the interrupted position.

A conventional drive means is provided on the apparatus for continuously driving the printing cylinder and inking assembly rollers of each printing assembly, regardless of the position of the impression cylinder relative to the printing cylinder. Preferably, a single drive shaft extends along the frame of the apparatus for driving all of the printing assemblies, as well as the scoring and slotting assemblies and the conveyor.

As shown in FIG. 1, the scoring assembly 16 is conventional, and includes one or more upper scoring wheels 90 supported for rotation on a drive shaft, and a lower anvil roller opposing the scoring wheels. Each scoring wheel includes a means for forming a crease in a blank as the blank is conveyed into the nip defined between the scoring wheel and the anvil roller to define a fold about which the blank can be folded to form a box.

The slotting assembly can either take the form of one of the slotting mechanisms illustrated in U.S. Pat. Nos. 5,297,462 and 5,327,804, or can be constructed in accordance with the preferred embodiment illustrated in FIGS. 6–8 of the present application. Regardless of the embodiment employed, the slotting assembly generally includes a slotting wheel mechanism for forming slots in the blanks, and an interrupting means for interrupting slotting on the fly during passage of each blank through the slotting assembly to enable a single series of slots to be made in each blank as the blanks are conveyed through the assembly, even when the blanks are of a length greater than the circumference of the slotter wheel mechanism used in the assembly.

Figure 7:
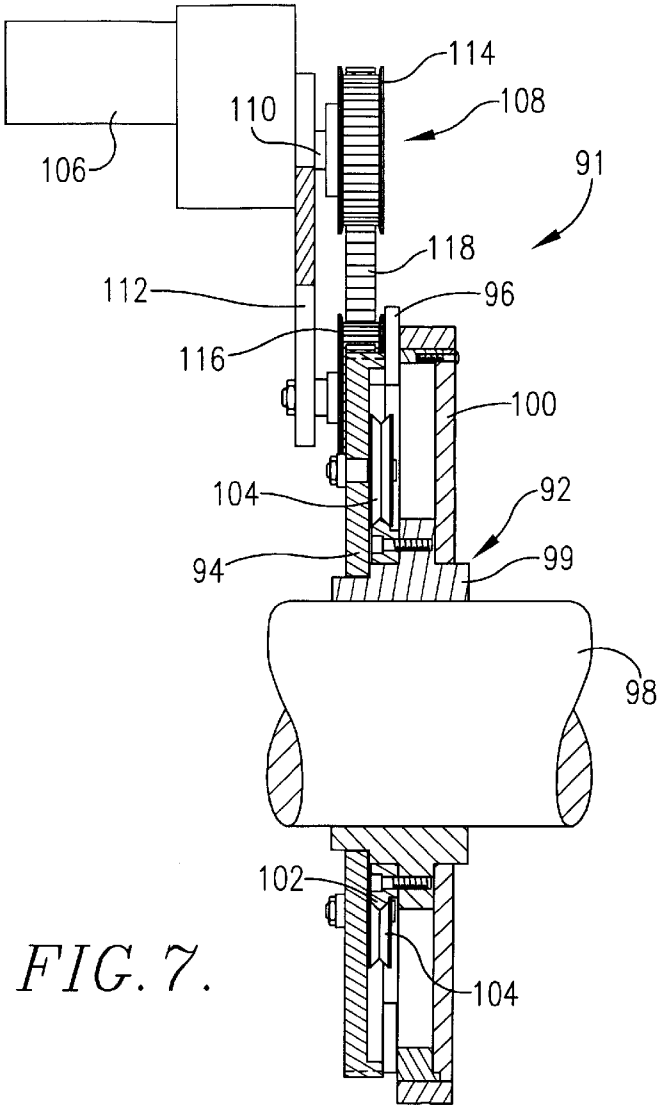
FIG. 7 is a fragmentary sectional view of the slotter wheel assembly, illustrating a single slotter wheel mechanism of the assembly.
Figure 6:
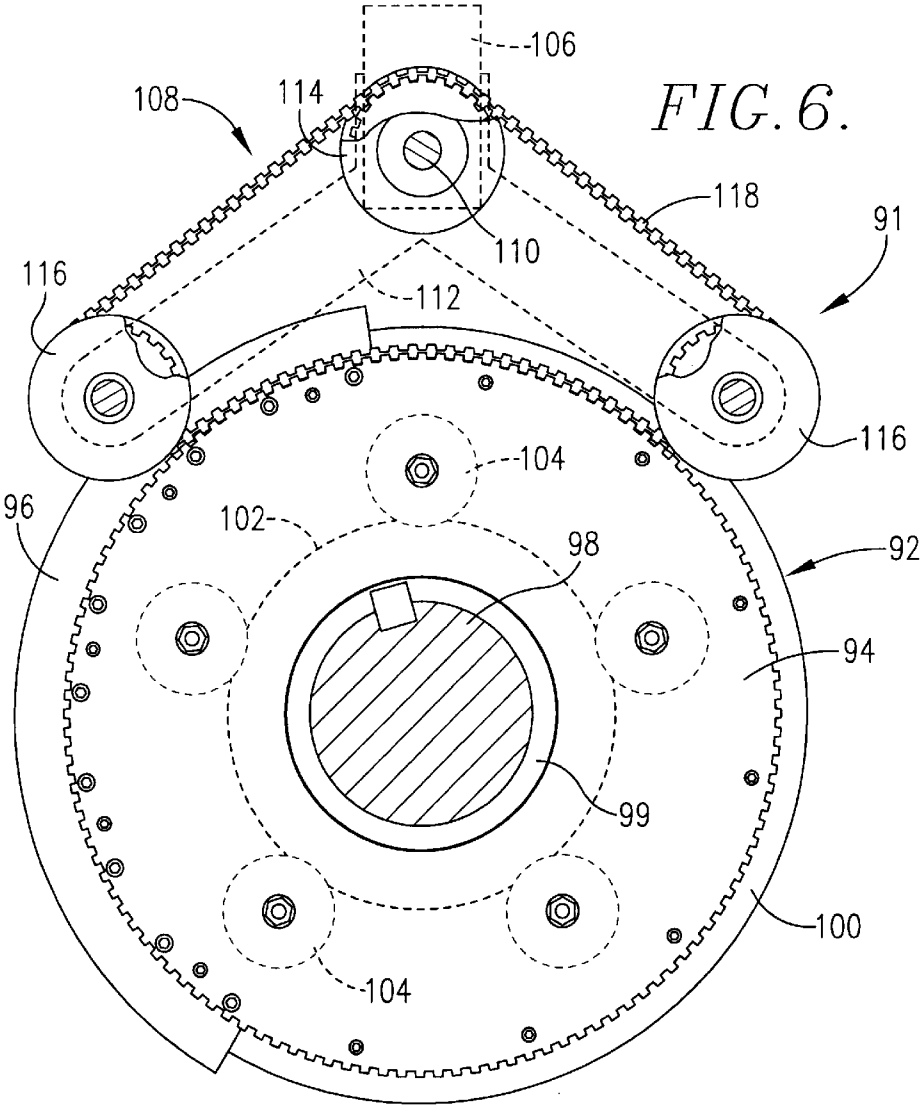
FIG. 6 is a side sectional view of a slotter wheel assembly forming a part of the box blank forming apparatus.
Figure 8:
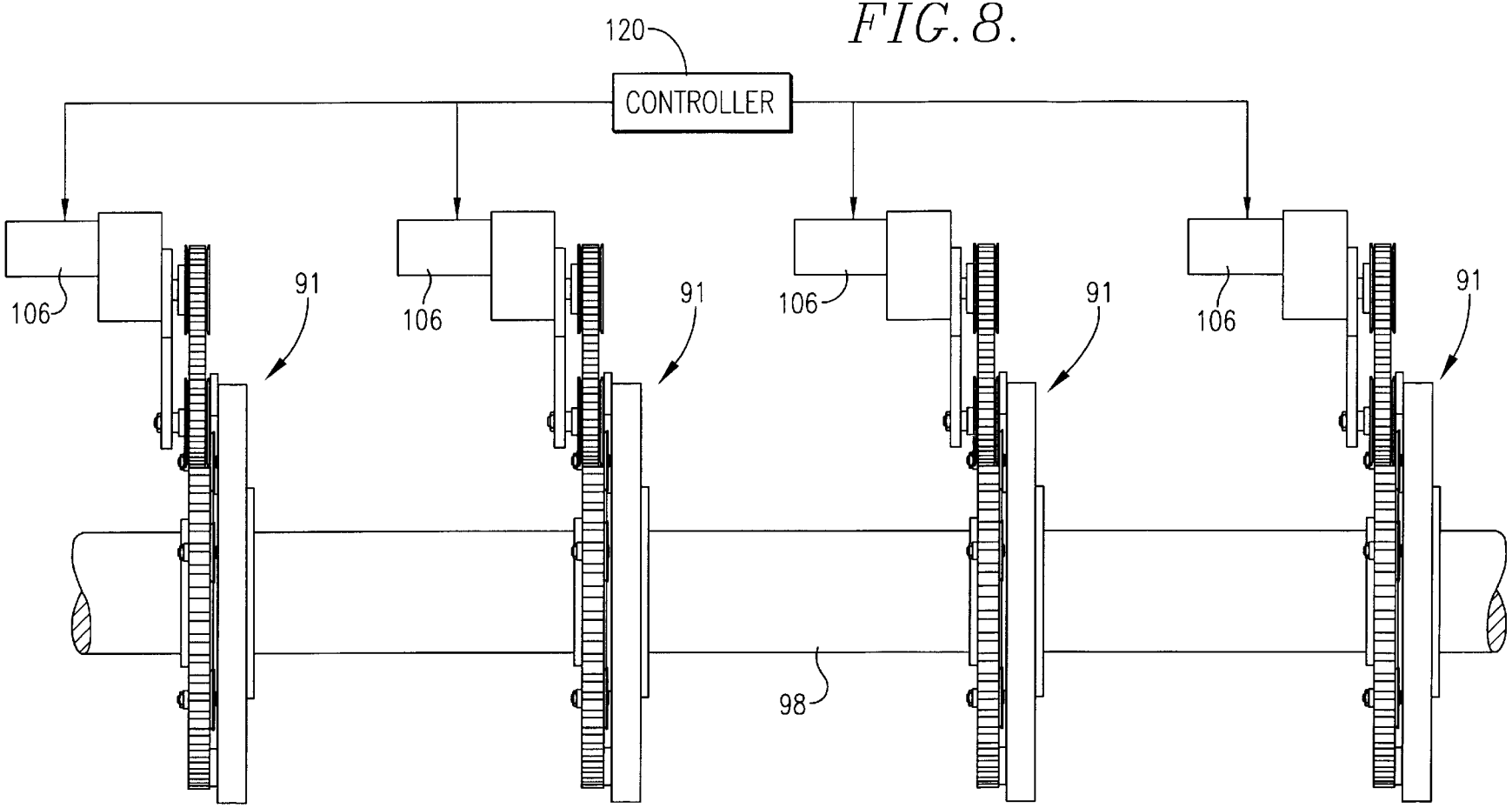
FIG. 8 is an end elevational view of the slotter wheel assembly.

Turning to FIG. 8, the preferred embodiment of the slotting assembly includes a plurality of slotting wheel mechanisms 91 spaced laterally from one another along a drive shaft 98. With reference to FIG. 7, each mechanism includes a rotatable drive assembly 92, a rotatable blade wheel 94, a slotter blade 96 coupled with the blade wheel, and support structure for supporting the blade wheel so that it rotates about the same axis as the drive assembly. The rotatable drive assembly broadly includes the drive shaft 98, a drive motor for rotating the shaft, a hub 99, and a drive wheel 100 secured to the hub. As illustrated in FIG. 6, the drive shaft includes a longitudinal keyway which permits the hub and drive wheel to be secured for rotation with the drive shaft.

The rotatable blade wheel 94 is provided for carrying the slotter blade 96 for making slots in the box blanks as they are fed through the assembly. The blade wheel is positioned adjacent the drive wheel 100 along the drive shaft 98 and is rotatable about the shaft. The support structure supports the blade wheel and slotter blade for rotation about the drive shaft and includes a circumferential track 102 and a plurality of blade wheel rollers 104. The track is supported on a stepped end section formed in the rear end face of the hub 99. The track rotates with the hub and is secured thereto by a plurality of screws. The track 102 is concentric with the drive shaft and presents an outer circumferential, inverted V-shaped track surface for engaging the blade wheel rollers 104.

The blade wheel rollers are rotatably coupled with the blade wheel by suitable fasteners that allow rotation of the blade wheel rollers. Each roller includes an outer circumferential groove shaped for receiving the V-shaped track surface of the circular track 102. Thus, the blade wheel rollers support the blade wheel for rotation about the drive wheel shaft.

The slotting assembly 18 also includes blade rotating structure for selectively rotating the slotter blade 96 relative to the drive wheel independently of the drive shaft.

In more detail, the blade rotating structure broadly includes a servo motor 106 and a gear assembly 108. The servo motor is coupled with a suitable source of electric power, and includes an output shaft 110. The gear assembly includes a support yoke 112, a drive pulley 114 and two idler pulleys 116. The support yoke is a metallic support member including a vertically extending leg section and two depending leg sections. The drive pulley is rotatably supported on the vertically extending leg of the yoke and is rotatably coupled with the servo motor output shaft. The idler pulleys are rotatably mounted on the depending leg sections of the yoke. A cogged belt 118 is positioned over the drive and idler pulleys and movement of the belt is driven by the servo motor. The cogged belt engages teeth formed along the circumference of the blade wheel. The blade rotating structure also includes a controller 120 for controlling the rotational speed of the servo motor.

In operation, the components of the blade rotating structure cooperate for rotating the slotter blade independently of the drive assembly. The rotational speed of the slotter blade 96 can be selectively adjusted relative to the rotational speed of the drive wheel so that the slotting blade can be placed in either a cutting position or an idle, non-cutting position. For example, the controller 120 and servo motor 106 can initially rotate the blade wheel 94 at the same rotational speed as the drive wheel 100 so that the slotter blade makes slots or cuts during every rotation of the drive wheel. Then, the controller and servo motor can stop the rotation of the blade wheel to allow the rotatable drive assembly to continue to advance a box blank without further slotting.

In the preferred embodiment of the apparatus, the controller 120 controls interruption of the printing assemblies and the slotting assembly to enable printing and slotting of universally sized box blanks. A sensing element 122 is provided along the conveyor for sensing the presence of each box blank as it is fed from the stack and for monitoring the progress of each blank through the apparatus. Preferably, this sensing element is an optical sensor or the like that is positioned at or near the upstream end of the conveyor. The optical sensing element detects the presence of each blank as it passes the element, and the controller 120 includes a means for tracking progress of the blank through the apparatus based upon the driven speed of the conveyor 28.

The controller 120 includes an input means for allowing an operator to input information relating to the length of the box blanks to be handled in any particular printing/slotting operation. In response to this inputted information, the controller actuates the piston-and-cylinder actuators 76 of the printing assemblies and the servo motor 106 of the slotting assembly in order to carry out printing and slotting only at the designated positions of each blank, and to interrupt printing and slotting along the remainder of the length of each blank, even when the length of the blanks is several times greater than the circumference of the printing cylinders or blade wheel. Thus, it is possible to combine control of the printing assembly and of a suitable slotter wheel mechanism to permit printing and slotting of such universally sized blanks in a single apparatus.

Although the present invention has been described with reference to the preferred embodiment, it is noted that equivalents may be employed and substitution made herein without departing from the scope of the invention as recited in the claims.

What is claimed is:

1. A sheet-fed box blank forming apparatus comprising:

a printing station having adjacent, rotatable printing and impression cylinders adapted to receive and imprint successively fed sheets;

a sheet feeder including an elongated, shiftable conveyor passing between the printing and impression cylinders to support successively fed sheets of variable length;

an interrupter for selectively moving the impression cylinder toward and away from the printing cylinder between a printing position in which the impression cylinder brings successively fed sheets passing between the cylinders into contact with the printing cylinder, and an interrupted position in which the impression cylinder and a portion of the conveyor adjacent the impression cylinder are spaced from the printing cylinder by a distance sufficient to allow sheet portions passing between the cylinders to remain out of contact with the printing cylinder; and a controller for selectively actuating the interrupter during passage of each sheet between the printing and impression cylinders and without stopping the rotation of the printing cylinder and movement of the sheet, said controller comprising a sensor proximal to said conveyor for sensing the presence of each box blank as it is fed by the sheet feeder, an input device allowing input of information relative to the length of the sheet fed by the sheet feeder, said controller operably coupled with said interrupter for selectively moving the impression cylinder to said printing position to print each sheet only at designated positions thereon and for selectively moving the impression cylinder to said interrupted position to interrupt printing of said sheet at other positions thereon.

2. The apparatus of claim 1, said impression cylinder comprising a pair of opposed ends, said interrupter including a pair of eccentric hubs respectively receiving said impression cylinder ends, and a rotator for rotating the hubs to shift the impression cylinder toward and away from the printing cylinder between said printing and interrupted positions.

3. The apparatus of claim 2, said hub rotator including a piston and cylinder actuator and a transmission for rotating the eccentric hubs in response to movement of the actuator.

4. The apparatus of claim 2, said interrupter including a brake for braking the rotation of the eccentric hubs at said printing and interrupted positions.

5. The apparatus of claim 2, said conveyor comprising an upper run passing between said printing and impression cylinders and an opposed lower run, said conveyor being perforated, said sheet feeder including a vacuum source for drawing a vacuum through the conveyor.

6. The apparatus of claim 5, said vacuum source including first and second vacuum beds adjacent to both the upper run of the conveyor and the impression cylinder, the vacuum beds each having a first end remote from the impression cylinder and supported for pivotal movement about an axis extending generally parallel with the longitudinal axis of the printing cylinder, and a second end that is supported on the eccentric hubs so that when the impression cylinder is shifted to the printing position, the conveyor and impression cylinder bring sheets passing between the printing and impression cylinders into contact with the printing cylinder, and when the impression cylinder is shifted to the interrupted position, the conveyor and impression cylinder are both spaced from the printing cylinder by a distance sufficient to convey sheets between the printing and impression cylinders out of contact with the printing cylinder.

7. The apparatus of claim 1, including a slotter having a rotatable blade for selectively forming slots in said sheets, the controller operably coupled with the slotter in order to control the operation of the slotter.

8. The apparatus of claim 1, including a plurality of spaced apart printing stations each having a respective interrupter, said controller being operably coupled with each of said printing stations for individual, selective control thereof.

9. A box blank forming apparatus for use in forming box blanks of variable length, the apparatus comprising:

a frame;

a printing cylinder having a central longitudinal axis and being supported on the frame for rotation about the longitudinal axis;

a drive means for driving rotation of the printing cylinder;

an impression cylinder supported on the frame for rotation about an axis parallel to the longitudinal axis of the printing cylinder;

a feeding means for feeding sheets along a travel path extending between the printing cylinder and the impression cylinder, the feeding means including a conveyor having an upper run extending along the travel path and between the printing and impression cylinders, and a lower run extending beneath the travel path and the printing and impression cylinders, the conveyor being perforated and the feeding means including a means for drawing a vacuum through the conveyor during operation of the apparatus to draw the sheets to the conveyor as the sheets are conveyed alone the travel path;

an interrupting means for moving the impression cylinder toward and away from the printing cylinder in a direction transverse to the travel path between a printing position in which the impression cylinder brings sheets passing between the cylinders into contact with the printing cylinder and an interrupted position in which the impression cylinder is spaced from the printing cylinder by a distance sufficient to allow sheets passing between the cylinders to remain out of contact with the Printing cylinder; and a control means for actuating the interrupting means to move the impression cylinder relative to the printing cylinder between the printing and interrupted positions during rotation of the printing cylinder and operation of the feeding means to enable a single impression to be made on each sheet as the sheets are passed between the cylinders, regardless of the length of the sheets, the impression cylinder including a pair of opposed axial ends, and the interrupting means including a pair of eccentric hubs within which the axial ends of the impression cylinder are supported for rotation, the interrupting means further including a means for rotating the hubs to shift the impression cylinder toward and away from the printing cylinder between the printing and interrupted positions, the means for drawing a vacuum through the conveyor including a vacuum bed supporting the upper run of the conveyor along the travel path on each side of the impression cylinder, the vacuum beds each including a first end that is remote from the impression cylinder and supported on the frame for pivotal movement about an axis extending in a direction parallel to the longitudinal axis of the printing cylinder, and a second end that is supported on the eccentric hubs so that when the impression cylinder is shifted to the printing position, the conveyor and impression cylinder bring sheets passing between the cylinders into contact with the printing cylinder, and when the impression cylinder is shifted to the interrupted position, the conveyor and impression cylinder are both spaced from the printing cylinder by a distance sufficient to convey sheets between the cylinders out of contact with the printing cylinder.

* * * * *